United States Patent [19]

Fikart

[11] 4,123,730

[45] Oct. 31, 1978

[54] SLOT TRANSMISSION LINE COUPLING TECHNIQUE USING A CAPACITOR

[75] Inventor: Josef L. Fikart, Port Coquitlam, Canada

[73] Assignee: GTE Lenkurt Electric (Canada) Ltd., Burnaby, Canada

[21] Appl. No.: 812,890

[22] Filed: Jul. 5, 1977

[51] Int. Cl.[2] ..... H01P 3/08; H01P 5/10

[52] U.S. Cl. ..... 333/26; 333/33; 333/84 M

[58] Field of Search ..... 333/33, 26, 84 R, 84 M

[56] References Cited

U.S. PATENT DOCUMENTS

| | | | |
|---|---|---|---|
| 3,678,395 | 7/1972 | Hunton et al. | 333/84 M X |
| 3,753,167 | 8/1973 | Cohn | 333/84 M X |
| 3,774,123 | 11/1973 | Hume | 333/84 M X |
| 3,995,239 | 11/1976 | Head et al. | 333/84 M X |

*Primary Examiner*—Paul L. Gensler
*Attorney, Agent, or Firm*—Douglas M. Gilbert

[57] ABSTRACT

A novel technique for coupling microwave signals to a slot transmission line and for effecting a simultaneous impedance transformation. One lead of a microwave capacitor, connects to a source of microwave signals via a microstrip or coplanar transmission line. The other capacitor lead, located in the same plane as the slot line, crosses the slot line at a right angle and connects to the ground plane on the other side of the slot. A short-circuited segment of the slot line extends $N\lambda/4$ beyond the point of crossing where N is an odd integer.

6 Claims, 6 Drawing Figures

SLOT TRANSMISSION LINE COUPLING TECHNIQUE USING A CAPACITOR

BACKGROUND OF THE INVENTION

In microwave circuits today, traditional metallic waveguide is being replaced by alternate structures, such as the microstrip (strip line), the coplanar line, and the slot line. This is particularly true for microwave integrated circuits where metallic waveguide cannot be used. The microstrip transmission line consists of a dielectric (usually a printed circuit board) with a thin copper ground plane on one side and a copper strip (the conductor) on the other side. The coplanar line is essentially the same structure as the microstrip except that the conductor strip and the ground plane are physically on the same side of the dielectric. The conductor strip in the coplanar line obviously must be insulated from the ground by an appropriate separation. And the slot line consists of a dielectric and copper ground plane with the ground plane being interrupted by a narrow slot or gap. The slot then becomes the microwave transmission line. A discussion of slot line parameters, including methods of coupling to a slot line, is found in "Slot Line Characteristics", by E. A. Mariani, et al, *IEEE Transactions on Microwave* Theory and Technique, Vol. MIT-17, pp. 1091–1096, Dec. 1969.

There now exists several standard methods of coupling a microwave signal from one type of structure to a slot line structure. The standard transition used for coupling from the microstrip-to-slot line is to overlap the two microwave lines. The microstrip conductor is on one side of the dielectric and the slotted ground plane (slot line) is on the other side. In microstrip-to-slot line coupling, the two transmission lines extend approximately one-quarter wavelength beyond the transition or crossing point. These quarter-wavelength sections represent frequency sensitive stubs, and when the microstrip and slot lines cross each other at right angles, the coupling will be especially tight and relatively wideband.

Another technique is used for wideband coupling between semi-rigid or miniature coaxial line to slot transmission line. The center conductor of the coaxial line is looped across one end of an electrically open-circuit slot line and soldered to the ground plane on the other side of the slot. The shielding outer conductor of the coaxial line is also connected to the ground plane. This wideband transition utilizing coaxial line is obviously limited to particular impedances such as 50 Ω or 70–75 Ω since these are the characteristic impedances of standard microwave coaxial lines. The microstrip-to-slot line coupling is not so limited by particular impedances since impedance in the microstrip and slot line is determined by the physical dimensions and electrical characteristics of the ground plane, conductor, and dielectric.

In complex microwave designs using microstrip, coplanar, or slot line techniques, it is often advantageous to make a transition from either a microstrip or coplanar circuit to a slot line circuit close to a point in the non slot line circuit where the impedance is not the same as the slot line. Since the two circuits must have the same characteristic impedance for optimum coupling and to prevent reflections, an impedance transformation must first be performed. This can be cone by effecting the impedance transformation with a capacitor in one medium (e.g. microstrip) first to obtain a standard impedance (e.g., 50 Ω). Following this transformation, one of the other standard coupling transitions would be used. For example, to go from a microstrip having an impedance, $Z_o$, to a slot line having an impedance, $Z_s$, the microstrip would be coupled first to an appropriate valued series capacitor. A coaxial cable would be connected to the other side of the capacitor, and then the standard coaxial line-slot transmission performed.

SUMMARY OF THE INVENTION

It is an object of this invention to provide a technique for achieving impedance transformation and a coupling transition to a slot line, both in a single step transition.

In one embodiment of this invention, a source of microwave signals, such as a microstrip line or a coplanar line, having a characteristic impedance $Z_o$, is electrically coupled to a slot transmission line having a characteristic impedance $Z_s$, $Z_s \neq Z_o$. The microwave frequency coupling is physically accomplished with a microwave capacitor having a value depending on the impedance transformation. One lead of the capacitor connects to the microwave source. The other capacitor lead, which is in the same plane as the slot, crosses the slot line at a right angle and connects to the ground plane on the other side. A short-circuited segment of the slot line extends $N\lambda/4$ beyond the point of crossing; where N is an odd integer and $\lambda$ is the wavelength of the microwave signal.

DETAILED DESCRIPTION OF PREFERRED EMBODIMENTS

Figure 1:
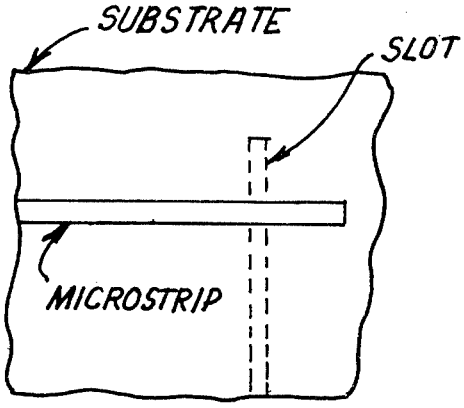
FIG. 1 PRIOR ART
FIG. 1 is the top view of a substrate illustrating a known technique for microstrip line-to-slot line coupling.
Figure 2:
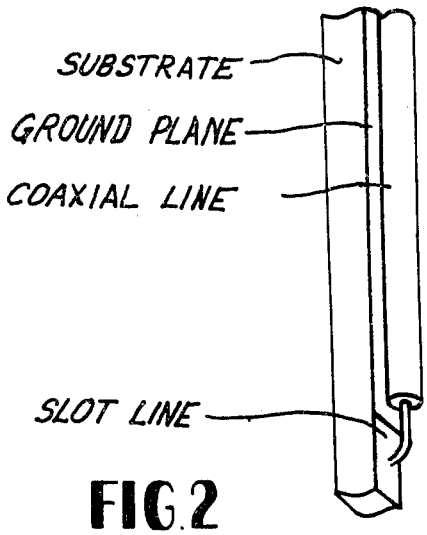
FIG. 2 PRIOR ART
FIG. 2 illustrates a known technique for coaxial-line-to slot line coupling.
Figure 3:
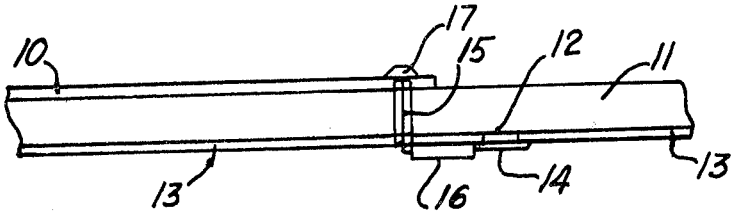
FIGS. 3 and 4 illustrate a new technique for coupling from a microstrip-line to slot line.

FIGS. 1 and 2 illustrate the known prior art techniques for coupling to a slot line and have heretofor been discussed. In FIG. 3, the microstrip line and slot line structures are illustrated. In FIG. 3 the microstrip line 10 is located on the top side of a substrate 11 which is typically a printed circuit board. The ground plane 13 associated with the microstrip line is located on the bottom of substrate 11. The slot 12 in the ground plane, which is a microwave slot transmission line, is seen more clearly in FIG. 4. To couple a microwave signal from the microstrip line 10 to the slot line 12, a microwave capacitor 16, such as a beam lead capacitor, is used. To physically connect the capacitor and microstrip, lead 15 of capacitor 16 is placed through a small hole in the substrate and ground plane. This hole is made just large enough so that lead 15 can be inserted and then connected to the end of microstrip 10. An electrical connection 17 is made with this lead and microstrip 10 by using either solder or conductive epoxy. Clearly, lead 15 must be positioned so that it does not short against ground plane 13. However, care must be taken not to remove too much ground plane in as much as the cutout can cause an electrical disturbance at frequencies of interest. Certainly, the precautions normally taken with microelectronic circuits must be followed here. The other lead 14 of capacitor 16 is placed at right angles and across the slot line 12 as shown in FIG. 3. The end of lead 14 is physically and electrically connected to the ground plane just on the other side of slot 12. As with the coaxial line shown in FIG. 2, the conductor looped across the slot line becomes the signal coupling vehicle.

Figure 4:
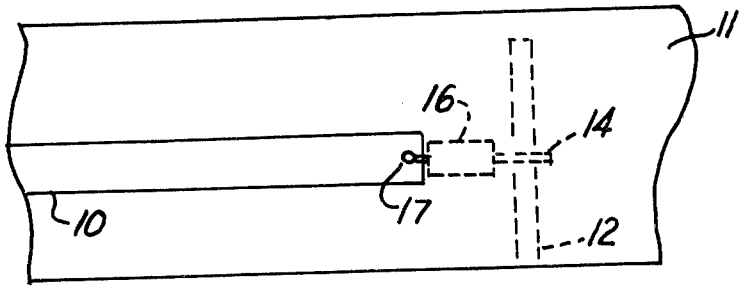

The slot line 12 would normally be terminated in some circuit element (at the bottom of FIG. 4) and the other end of the slot line is electrically grounded. Only a part of the entire substrate is shown in FIG. 4. The upper segment of slot line 12 extends beyond the point of crossing with lead 14 by an amount approximately equal in length to $N\lambda/4$ where N is an odd integer and $\lambda$ is the wavelength of the microwave signal. To conserve space on the substrate this segment is normally only one-quarter wavelength long. Similar to the prior art, to obtain optimum impedance matching this length has to be slightly modified to account for the effect of the inevitable parasitics in the circuit and also for that of the capacitor.

Figure 5:
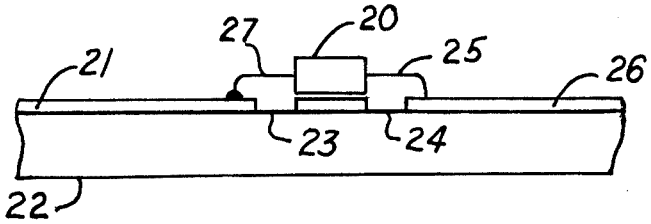
FIGS. 5 and 6 illustrate a new technique for coupling from a coplanar line-to-slot line.
Figure 6:
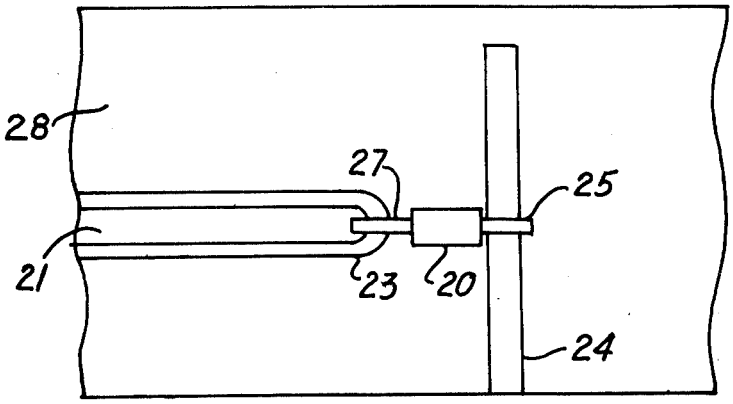

In another embodiment of this invention, a coplanar line may be similarly coupled to a slot transmission line as illustrated in FIGS. 5 and 6. As with FIGS. 3 and 4, only a segment of the coplanar line 21 and slot line 24 are shown in these two figures. The conductor 21 of the coplanar line is separated from ground plane 28 by a separation 23 having dimensions which depend on the desired electrical characteristics of the coplanar line. Capacitor 20, with leads 27 and 25, couples the microwave signal from line 21 to slot 24 much the same way as the microstrip coupling technique. Since both coplanar line and slot are in the same physical plane, no hole need be placed in substrate 22. Lead 27 is physically connected to coplanar 21 at the very tip of the conductor. Lead 25 is connected across slot 24 at a right angle, and is physically and electrically connected to the ground plane on the other side of the slot. Like the microstrip technique, the end of the slot line extends beyond the point of crossing by approximately $N\lambda/4$—usually one-quarter wavelength. The exact length should be adjusted for optimum impedance matching, i.e., coupling efficiency.

The invention described herein is more general than what has been shown in FIGS. 3–6. Although the technique is not universal, it can be applied whenever capacitive coupling would be used for impedance transformation, and the exact value of capacitance will depend on the particular impedance transformation desired.

The technique of using one lead of the capacitor to transfer the microwave signal to the slot line does not affect the normal procedure for the selection of the value of capacitance to obtain the desired impedance transformation.

What is claimed is:

1. Apparatus for coupling a microstrip transmission line to a slot transmission line and for effecting an impedance transformation, said apparatus comprising:

said microstrip transmission line having a characteristic impedance $Z_o$ and capable of propagating a microwave signal having a wavelength $\lambda$;

said slot transmission line having a characteristic impedance $Z_s$, $Z_s \neq Z_o$, said slot line consisting of a narrow slot in a conductive coating on one side of a dielectric substrate, said slot further having a segment with one end electrically at the same potential as the conductive coating; and a microwave capacitor having a first lead connected to said microstrip and a second lead connected to said conductive coating, said second lead positioned across and at right angles to said slot transmission line and such that said slot segment extends $N\lambda/4$ beyond the point said second lead crosses said slot line, where N is an odd integer.

2. Apparatus as in claim 1 whereinn $N = 1$.

3. Apparatus as in claim 2 wherein said microwave capacitor further comprises a beam lead capacitor.

4. Apparatus for coupling a microwave coplanar transmission line to a slot transmission line and for effecting an impedance transformation, said apparatus comprising:

said microwave coplanar transmission line having a characteristic impedance $Z_o$ and capable of propagating a microwave signal having a wavelength $\lambda$;

said slot transmission line having a characteristic impedance $Z_s$, $Z_s \neq Z_o$, said slot line consisting of a narrow slot in a conductive coating on one side of a dielectric substrate, said slot further having a segment with one end electrically at the same potential as the conductive coating; and a microwave capacitor having a first lead connected to said microwave coplanar transmission line and a second lead connected to said conductive coating, said second lead positioned across and at right angles to said slot transmission line and such that said slot segment extends $N\lambda/4$ beyond the point said second lead crosses said slot line, where N is an odd integer.

5. Apparatus as in claim 4 wherein $N = 1$.

6. Apparatus as in claim 5 wherein said microwave capacitor further comprises a beam lead capacitor.

* * * * *